US006182654B1

(12) United States Patent
Jones

(10) Patent No.: US 6,182,654 B1
(45) Date of Patent: Feb. 6, 2001

(54) WOODSTOVE EMISSION CONTROLLER

(76) Inventor: Virginia C. Jones, 3932 N. Hwy.#119, Mebane, NC (US) 27302

( * ) Notice: Under 35 U.S.C. 154(b), the term of this patent shall be extended for 0 days.

(21) Appl. No.: 09/502,299

(22) Filed: Feb. 11, 2000

(51) Int. Cl.[7] ..... F23J 11/00

(52) U.S. Cl. ..... 126/312; 126/80; 126/293; 110/162

(58) Field of Search ..... 126/77, 76, 307 R, 126/312, 307 A, 80, 292, 285 R; 236/45; 110/162, 163, 184

(56) References Cited

U.S. PATENT DOCUMENTS 3,431,056 * 3/1969 Winegardner ..... 110/162
3,587,490 * 6/1971 Martin ..... 110/162
4,270,513 * 6/1981 Mitchelson ..... 110/162
4,449,512 * 5/1984 Mitchelson ..... 110/162
4,545,360 * 10/1985 Smith ..... 126/80

* cited by examiner

*Primary Examiner*—James C. Yeung

(57) ABSTRACT

A woodstove emission controller for conveniently drawing emissions from the wood-stove so that the emissions do not enter the room where the wood-stove is located. The wood-stove emission controller includes a tubular member having an inlet end, an outlet end and a bore extending there-through; and also includes a closure member securely disposed in the bore near the outlet end for preventing a back-draft of emissions; and further includes a fan member securely and rotatably disposed in the bore for drawing emissions in through the inlet end and out through the outlet end of the tubular member; and also includes a motor mounted to the exterior of the tubular member, a belt member carried by the motor and the fan member, and a switch for energizing the motor.

11 Claims, 1 Drawing Sheet

WOODSTOVE EMISSION CONTROLLER

BACKGROUND OF THE INVENTION

1. Field of the Invention

The present invention relates to a wood-stove smoke controller and more particularly pertains to a new woodstove emission controller for conveniently drawing emissions from the wood-stove so that the emissions do not enter the room where the wood-stove is located.

2. Description of the Prior Art

The use of wood-stove smoke controller is known in the prior art. More specifically, wood-stove smoke controller heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,280,476; 4,510,854; 4,424,799; 4,708,123; U.S. Pat. No. Des. 266,867; and U.S. Pat. No. 4,469,284.

While these devices fulfill their respective, particular objectives and requirements, the aforementioned patents do not disclose a new woodstove emission controller. The inventive device includes a tubular member having an inlet end, an outlet end and a bore extending therethrough; and also includes a closure member securely disposed in the bore near the outlet end for preventing a back-draft of emissions; and further includes a fan member securely and rotatably disposed in the bore for drawing emissions in through the inlet end and out through the outlet end of the tubular member; and also includes a motor mounted to the exterior of the tubular member, a belt member carried by the motor and the fan member, and a switch for energizing the motor.

In these respects, the woodstove emission controller according to the present invention substantially departs from the conventional concepts and designs of the prior art, and in so doing provides an apparatus primarily developed for the purpose of conveniently drawing emissions from the wood-stove so that the emissions do not enter the room where the wood-stove is located.

SUMMARY OF THE INVENTION

In view of the foregoing disadvantages inherent in the known types of wood-stove smoke controller now present in the prior art, the present invention provides a new woodstove emission controller construction wherein the same can be utilized for conveniently drawing emissions from the wood-stove so that the emissions do not enter the room where the wood-stove is located.

The general purpose of the present invention, which will be described subsequently in greater detail, is to provide a new woodstove emission controller which has many of the advantages of the wood-stove smoke controller mentioned heretofore and many novel features that result in a new woodstove emission controller which is not anticipated, rendered obvious, suggested, or even implied by any of the prior art wood-stove smoke controller, either alone or in any combination thereof.

To attain this, the present invention generally comprises a tubular member having an inlet end, an outlet end and a bore extending therethrough; and also includes a closure member securely disposed in the bore near the outlet end for preventing a back-draft of emissions; and further includes a fan member securely and rotatably disposed in the bore for drawing emissions in through the inlet end and out through the outlet end of the tubular member; and also includes a motor mounted to the exterior of the tubular member, a belt member carried by the motor and the fan member, and a switch for energizing the motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new woodstove emission controller which has many of the advantages of the wood-stove smoke controller mentioned heretofore and many novel features that result in a new woodstove emission controller which is not anticipated, rendered obvious, suggested, or even implied by any of the prior art wood-stove smoke controller, either alone or in any combination thereof.

It is another object of the present invention to provide a new woodstove emission controller which may be easily and efficiently manufactured and marketed.

It is a further object of the present invention to provide a new woodstove emission controller which is of a durable and reliable construction.

An even further object of the present invention is to provide a new woodstove emission controller which is susceptible of a low cost of manufacture with regard to both materials and labor, and which accordingly is then susceptible of low prices of sale to the consuming public, thereby making such woodstove emission controller economically available to the buying public.

Still yet another object of the present invention is to provide a new woodstove emission controller which provides in the apparatuses and methods of the prior art some of the advantages thereof, while simultaneously overcoming some of the disadvantages normally associated therewith.

Still another object of the present invention is to provide a new woodstove emission controller for conveniently drawing emissions from the wood-stove so that the emissions do not enter the room where the wood-stove is located.

Yet another object of the present invention is to provide a new woodstove emission controller which includes a tubular member having an inlet end, an outlet end and a bore extending therethrough; and also includes a closure member securely disposed in the bore near the outlet end for preventing a back-draft of emissions; and further includes a fan member securely and rotatably disposed in the bore for drawing emissions in through the inlet end and out through the outlet end of the tubular member; and also includes a motor mounted to the exterior of the tubular member, a belt member carried by the motor and the fan member, and a switch for energizing the motor.

Still yet another object of the present invention is to provide a new woodstove emission controller that safeguards against fumes from the wood-stove from getting into the user's house.

Even still another object of the present invention is to provide a new woodstove emission controller that can be easily and quickly installed in the pipe of a wood-stove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
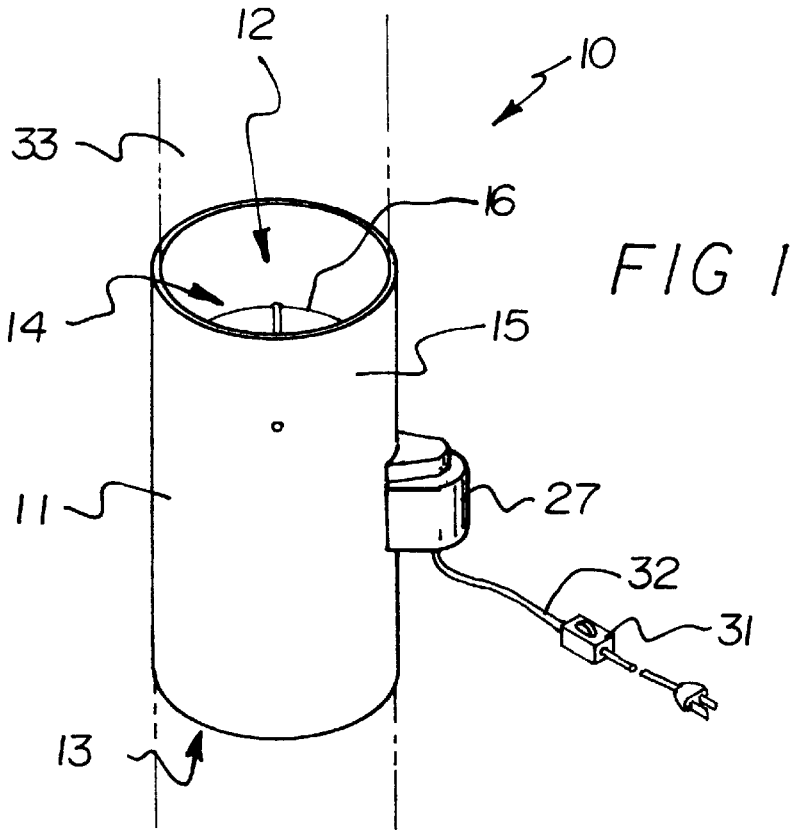
FIG. 1 is a perspective view of a new woodstove emission controller according to the present invention.
Figure 2:
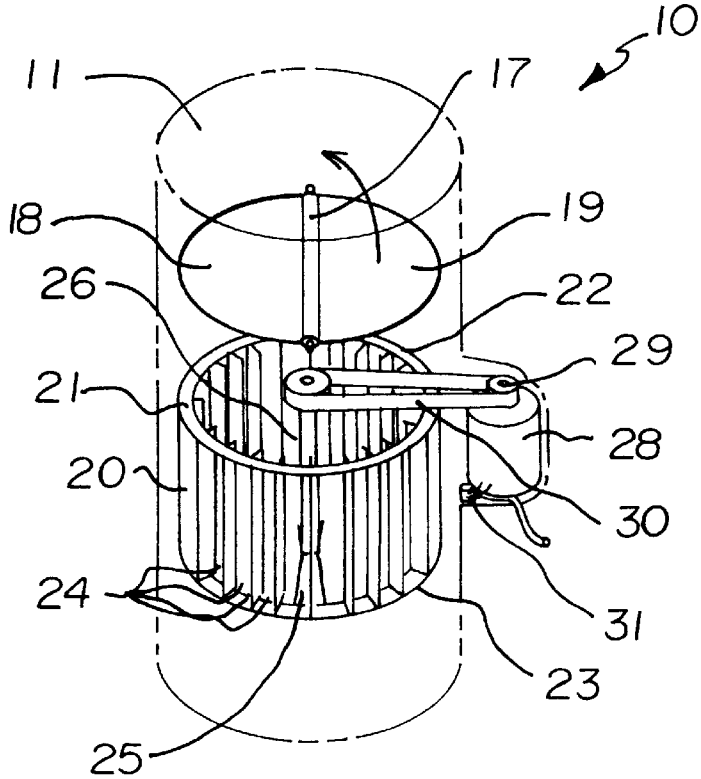
FIG. 2 is a detailed perspective view of the present invention.

With reference now to the drawings, and in particular to FIGS. 1 through 2 thereof, a new woodstove emission controller embodying the principles and concepts of the present invention and generally designated by the reference numeral 10 will be described.

As best illustrated in FIGS. 1 through 2, the woodstove emission controller 10 generally comprises a tubular member 11 having an inlet end 13, an outlet end 12 and a bore 14 extending therethrough and being adapted to be securely mounted in a pipe 33 of the wood-stove. A closure member 16 is securely mounted in the bore 14 of the tubular member 11 near the outlet end 12 for preventing a back-draft of emissions. The closure member 16 includes a spindle 17 having ends which are securely disposed in a side wall 15 and to either side of the bore 14 of the tubular member 11, and further includes a pair of flap members 18,19 each having an end which is hingedly mounted to the spindle 17 for preventing a back-draft of emissions. Each of the flap members 18,19 is semi-circular shaped with the flap members 18,19 being adapted to close the bore 14. A fan member 20 is securely and conventionally disposed in the tubular member 11 for drawing smoke through the pipe 33. The fan member 20 includes a cylindrical frame 21 having a top ring member 22, a bottom ring member 23, a plurality of blade members 24 disposed parallel to a longitudinal axis of the tubular member 11 and securely and conventionally interconnecting the top ring member 22 to the bottom ring member 23 and being spaced along a circumference of the cylindrical frame 21. The fan member 20 further includes a cross member 25 having ends securely attached and welded to the bottom ring member 23. The fan member 20 also includes a shaft member 26 securely attached and welded to the cross member 25 and extending co-axially of the tubular member 11 with the fan member 20 being essentially a centrifugal fan which draws emissions in through the inlet end 13 and out through the outlet end 12 of the tubular member 11. A means for actuating and driving the fan member 20 includes a housing 27 which is securely and conventionally mounted to an exterior of the side wall 15 of the tubular member 11, and further includes a motor 28 being securely and conventionally disposed in the housing 27 and having a motor shaft 29, and also includes a belt member 30 being carried by the motor shaft 29 and the shaft member 26, and further includes a switch 31 for energizing the motor 28. The switch 31 includes a power cord 32 which is adapted to be plugged into a power source with the switch 31 being a thermostatic switch.

In use, the user turns on the switch 31 which energizes the motor 28 which turns the shaft member 26 which turns the fan member 20 thus causing the fan member 20 to draw the emissions in through the inlet end 13 and out through the outlet end 12 of the tubular member 11. In the alternative, the motor 28 would be energized by the thermostatic switch 31 when the temperature in the bore 14 of the tubular member 11 reaches a certain temperature.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wood-stove emission controller comprising:

a tubular member having an inlet end, an outlet end and a bore extending there-through and being adapted to be securely amounted in a pipe of the wood-stove;

a closure member being securely mounted in said bore of said tubular member near said outlet end for preventing a back-draft of emissions;

a fan member securely disposed in said tubular member for drawing smoke through the pipe;

a means for actuating and driving said fan member;

wherein said means for actuating and driving said fan member includes a housing which is securely mounted to an exterior of a side wall of said tubular member, a motor being securely disposed in said housing and having a motor shaft and a shaft member, and a switch for energizing said motor; and wherein said fan member includes a cylindrical frame having a top ring member, a bottom ring member, a plurality of blade members disposed parallel to a longitudinal axis of said tubular member and securely interconnecting said top ring member to said bottom ring member and being spaced along a circumference said cylindrical frame, said fan member further including a cross member having ends securely attached to said bottom ring member, said fan member also including said shaft member securely attached to said cross member and extending co-axially of said tubular member.

2. A wood-stove emission controller as described in claim 1, wherein said closure member includes a spindle having ends which are securely disposed in a side wall and to either side of said bore of said tubular member, and further includes a pair of flap members each having an end which is hingedly mounted to said spindle for preventing a back-draft of emissions.

3. A wood-stove emission controller as described in claim 2, wherein said each of said flap members is semi-circular shaped.

4. A wood-stove emission controller as described in claim 2, wherein said flap members are adapted to close said bore.

5. A wood-stove emission controller as described in claim 1, wherein said fan member is essentially a centrifugal fan which draws emissions in through said inlet end and out through said outlet end of said tubular member.

6. A wood-stove emission controller as described in claim 1, wherein said switch includes a power cord which is adapted to be plugged into a power source.

7. A wood-stove emission controller as described in claim 6 wherein, said switch is a thermostatic switch.

8. A wood-stove emission controller comprising:

a tubular member having an inlet end, an outlet end and a bore extending there-through and being adapted to be securely mounted in a pipe of the wood-stove;

a closure member being securely mounted in said bore of said tubular member near said outlet end for preventing a back-draft of emissions;

a fan member securely disposed in said tubular member for drawing smoke through the pipe;

a means for actuating and driving said fan member;

wherein said means for actuating and driving said fan member includes a housing which is securely mounted to an exterior of a side wall of said tubular member; a motor being securely disposed in said housing and having a motor shaft; a belt member being carried by said motor shaft and a shaft member, and a switch for energizing said motor;

wherein said closure member includes a spindle having ends which are securely disposed in a side wall and to either side of said bore of said tubular member, and further includes a pair of flap members each having an end which is hingedly mounted to said spindle for preventing a back-draft of emissions;

wherein said each of said flap members is semi-circular shaped;

wherein said flap members are adapted to close said bore;

wherein said fan member includes a cylindrical frame having a top ring member, a bottom ring member, a plurality of blade members disposed parallel to a longitudinal axis of said tubular member and securely interconnecting said top ring member to said bottom ring member and being spaced along a circumference of said cylindrical frame, said fan member further including a cross member having ends securely attached to said bottom ring member, said fan member also including said shaft member securely attached to said cross member and extending co-axially of said tubular member; and wherein said fan member is essentially a centrifugal fan which draws emissions in through said inlet end and out through said outlet end of said tubular member.

9. The wood-stove emission controller of claim 8, wherein said switch includes a power cord which is adapted to be plugged into a power source.

10. The wood-stove emission controller as described in claim 8, wherein said switch is a thermostatic switch.

11. A wood-stove emission controller comprising:

a tubular member having an inlet end, an outlet end and a bore extending there-through and being adapted to be securely mounted in a pipe of the wood-stove;

a closure member being securely mounted in said bore of said tubular member near said outlet end of preventing a back-draft of emissions, said closure member including a spindle having ends which are securely disposed in a side wall and to either side of said bore of said tubular member, and further including a pair of flap members each having an end which is hingedly mounted to said spindle for preventing a back-draft of emissions, each of said flap members being semi-circular shaped, said flap members being adapted to close said bore;

a fan member securely disposed in said tubular member for drawing smoke through the pipe, said fan member including a cylindrical frame having a top ring member, a bottom ring member, a plurality of blade members disposed parallel to a longitudinal axis of said tubular member and securely interconnecting said top ring member to said bottom ring member and being spaced along a circumference of said cylindrical frame, said fan member further including a cross member having ends securely attached to said bottom ring member, said fan member also including a shaft member securely attached to said cross member and extending co-axially of said tubular member, said fan member being essentially a centrifugal fan which draws emissions in through said inlet end and out through said outlet end of said tubular member; and a means for actuating and driving said fan member including a housing which is securely mounted to an exterior of said side wall of said tubular member; a motor being securely disposed in said housing and having a motor shaft; a belt member being carried by said motor shaft and said shaft member, and a switch for energizing said motor, said switch including a power cord which is adapted to be plugged into a power source, said switch being a thermostatic switch.

* * * * *